US007446708B1

(12) United States Patent
Nguyen et al.

(10) Patent No.: US 7,446,708 B1
(45) Date of Patent: Nov. 4, 2008

(54) MULTIBAND MONOPOLE ANTENNA WITH INDEPENDENT RADIATING ELEMENTS

(75) Inventors: Anthony H. Nguyen, San Diego, CA (US); Jatupum Jenwatanavet, San Diego, CA (US); Huan-Sheng Hwang, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 369 days.

(21) Appl. No.: 11/260,588

(22) Filed: Oct. 27, 2005

Related U.S. Application Data

(63) Continuation-in-part of application No. 10/818,063, filed on Apr. 5, 2004, now Pat. No. 7,019,696, which is a continuation of application No. 10/228,693, filed on Aug. 26, 2002, now Pat. No. 6,741,213.

(51) Int. Cl.
*H01Q 1/38* (2006.01)

(52) U.S. Cl. ..... 343/700 MS; 343/702; 343/895

(58) Field of Classification Search ..... 343/700 MS, 343/895, 702, 846
See application file for complete search history.

(56) References Cited

U.S. PATENT DOCUMENTS 6,198,442 B1 * 3/2001 Rutkowski et al. ..... 343/702
6,239,765 B1 * 5/2001 Johnson et al. ..... 343/795
6,337,667 B1 1/2002 Ayala et al.
6,603,430 B1 * 8/2003 Hill et al. ..... 343/702
6,741,213 B2 5/2004 Jenwatanavet
6,882,319 B2 4/2005 Jinushi
2001/0052877 A1 * 12/2001 Honda et al. ..... 343/702
2007/0069954 A1 * 3/2007 Kenoun et al. ..... 343/700 MS
2007/0152887 A1 * 7/2007 Castany et al. ..... 343/702

* cited by examiner

*Primary Examiner*—HoangAnh T Le

(57) ABSTRACT

A single-feedpoint multiband monopole antenna is provided with independent radiator elements. The antenna comprises a microstrip counterpoise coupler having a single-feedpoint interface, a first radiator interface, and a second radiator interface. A first microstrip radiator, i.e. a meander line microstrip, has an end connected to the counterpoise coupler first radiator interface, and an unterminated end. A second microstrip radiator, i.e. a straight-line microstrip, has an end connected to the counterpoise coupler second radiator interface, and an unterminated end. The two radiators are capable of resonating at non-harmonically related frequencies. As with the two microstrip radiators, the microstrip counterpoise coupler is a conductive trace formed overlying a sheet of dielectric material. The counterpoise coupler can come in a variety of shapes, so that the overall antenna may take on a number of form factors.

16 Claims, 7 Drawing Sheets

RECTANGULAR / EQUAL PITCH

RECTANGULAR / EQUAL PITCH / UNEQUAL HEIGHT

ZIG-ZAG SHAPE

ROUND SHAPE

Fig. 5B
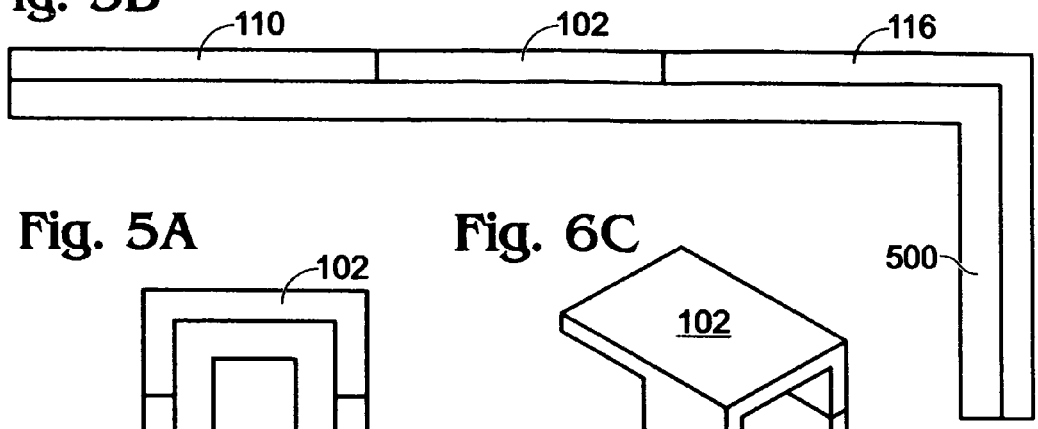
Fig. 5A
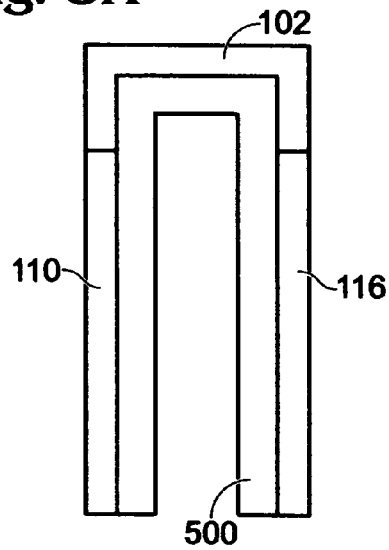
Fig. 6C
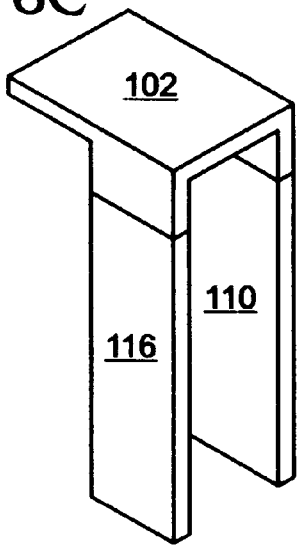
Fig. 6A
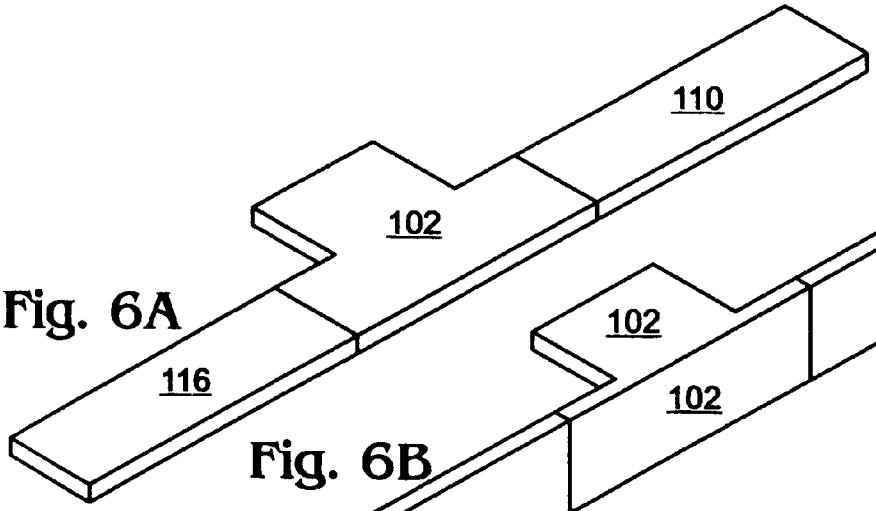
Fig. 6B Fig. 11
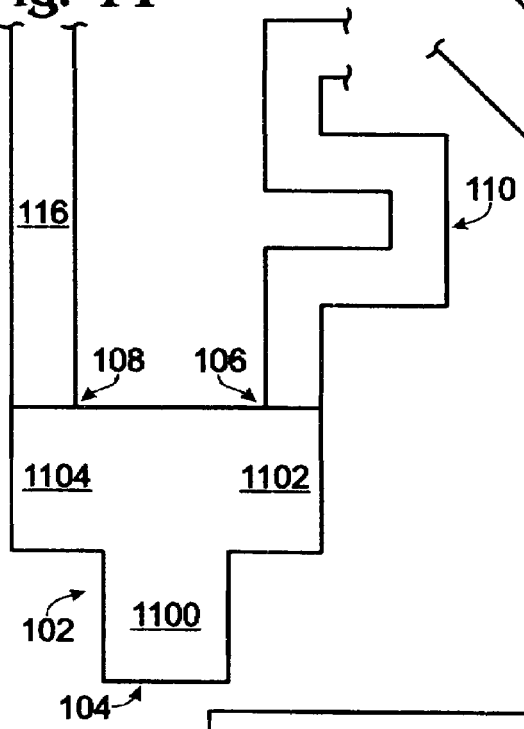
Fig. 12
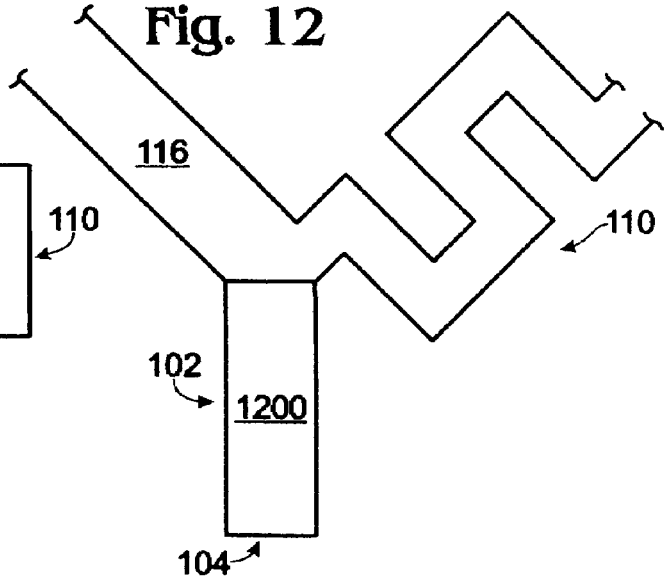
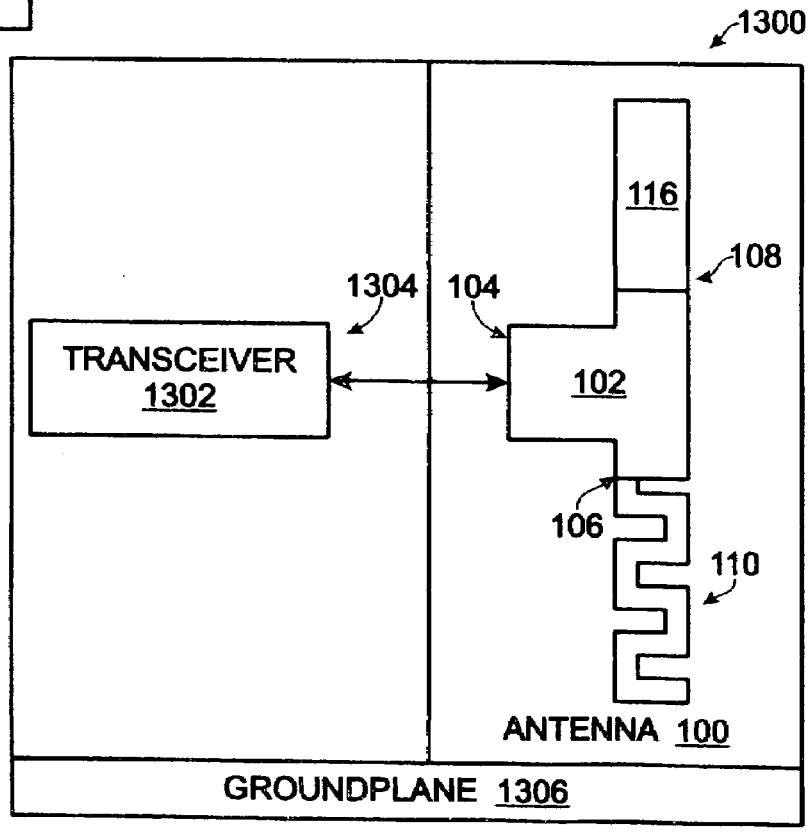
Fig. 13

MULTIBAND MONOPOLE ANTENNA WITH INDEPENDENT RADIATING ELEMENTS

RELATED APPLICATIONS

This application is a Continuation-in-Part Application of U.S. application Ser. No. 10/818,063, filed Apr. 5, 2004 now U.S. Pat. No. 7,019,696, which is a Continuation Application of U.S. application Ser. No. 10/228,693, filed Aug. 26, 2002, now U.S. Pat. No. 6,741,213, the entire disclosures of which are incorporated herein by reference.

FIELD OF THE INVENTION

This invention generally relates to wireless communications and, more particularly, to a multiband microstrip monopole antenna, where the radiation patterns are independent of the position of the radiators with respect to each other.

BACKGROUND OF THE INVENTION

Wireless communications devices, a wireless telephone or laptop computer with a wireless transponder for example, are known to use simple cylindrical coil antennas as either the primary or secondary communication antennas. The resonance frequency of the antenna is responsive to its electrical length, which forms a portion of the operating frequency wavelength. The electrical length of a wireless device helical antenna is often a ratio such as $3\lambda/4$, $5\lambda/4$, or $\lambda/4$, where $\lambda$ is the wavelength of the operating frequency, and the effective wavelength is responsive to the dielectric constant of the proximate dielectric.

Wireless telephones can operate in a number of different frequency bands. In the US, the cellular band (AMPS) at around 850 megahertz (MHz), and the PCS (Personal Communication System) band at around 1900 MHz, are used. Other frequency bands include the PCN (Personal Communication Network) at approximately 1800 MHz, the GSM system (Groupe Speciale Mobile) at approximately 900 MHz, and the JDC (Japanese Digital Cellular) at approximately 800 and 1500 MHz. Other bands of interest are global positioning satellite (GPS) signals at approximately 1575 MHz and Bluetooth at approximately 2400 MHz.

Wireless devices that are equipped with transponders to operate in multiple frequency bands must have antennas tuned to operate in the corresponding frequency bands. Equipping such a wireless device with discrete antenna for each of these frequency bands is not practical as the size of these devices continues to shrink, even as more functionality is added. Nor is it practical to expect users to disassemble devices to swap antennas. Even if multiple antennas could be designed to be co-located, so as to reduce the space requirement, the multiple antenna feed points, or transmission line interfaces still occupy valuable space. Further, each of these discrete antennas may require a separate matching circuit.

For example, an antenna can be connected to a laptop computer PCMCIA modem card external interface for the purpose of communicating with a cellular telephone system at 800 MHz, or a PCS system at 1900 MHz. A conventional single-coil helical antenna is a good candidate for this application, as it is small compared to a conventional whip antenna. The small size makes the helical antenna easy to carry when not attached to the laptop, and unobtrusive when deployed. The single-coil helical antenna has a resonant frequency and bandwidth that can be controlled by the diameter of coil, the spacing between turns, and the axial length. However, such a single-coil helical antenna will only operate at one of the frequencies of interest, requiring the user to carry multiple antennas, and also requiring the user to make a determination of which antenna to deploy.

Multiband antennas have been built to address the conflicting goals of a small size and the ability to operate in multiple frequency bands. Dipole antennas are inherently larger due to a two-radiator design. Other antenna designs, with an inherently smaller form factor, are sensitive to the relative position of other radiators and the grounds. Sub-optimal performance is often due to the positional change of the ground planes relative to the antenna. An antenna that depends heavily on the ground plane, such as a patch antenna, planar inverted-F antenna (PIFA), or folded monopole, may perform poorly when a grounded metal is near the antenna in some configurations. Likewise, the performance of one, ground-dependent, radiator is susceptible to proximately located radiators.

Some multiband antenna designs are made smaller by connecting the radiating elements in series. However, any change to one of the radiators affects the performance of others in the series. This interdependence between radiators makes the antenna difficult to design. In use, all the radiators can be affected, even if only one radiator becomes detuned due a proximate object or changing groundplane.

Poor antenna performance can be characterized by the amount of current unintentionally generated through a transceiving device, typically as surface currents, as opposed to amount of energy radiated into the intended transmission medium (i.e., air). From the point of view of a transmitter, poor antenna performance can be measured as less radiated power, or less power in an intended direction. From the receiver perspective, poor antenna performance is associated with degraded sensitivity due to noisy grounds. From either point of view, poor performance can be associated with radio frequency (RF) ground currents.

SUMMARY OF THE INVENTION

An antenna is presented that can simultaneously transceive electromagnetic energy in multiple frequency bands, so as to be useful in a device communicating in GSM, TDMA, GPS, and CDMA frequency bands. More specifically, a two-radiator monopole design antenna is described. One radiator can be formed as a meandering microstrip line to operate a relatively low frequencies, i.e., the AMPS band at 800 MHz, while a straight-line microstrip line acts as a higher frequency radiator with a broad bandpass, broad enough to effectively resonate GPS (1575 MHz) and PCS (1900 MHz) frequencies for example. Advantageously, there is a minimum of interaction between radiators, so that the antenna can be formed to fit on flexible materials or on a device case.

Accordingly, a single-feedpoint multiband monopole antenna is provided with independent radiator elements. The antenna comprises a microstrip counterpoise coupler having a single-feedpoint interface, a first radiator interface, and a second radiator interface. A first microstrip radiator, i.e. a meander line microstrip, has an end connected to the counterpoise coupler first radiator interface, and an unterminated end. A second microstrip radiator, i.e. a straight-line microstrip, has an end connected to the counterpoise coupler second radiator interface, and an unterminated end. The two radiators are capable of resonating at non-harmonically related frequencies.

As with the two microstrip radiators, the microstrip counterpoise coupler is a conductive trace formed overlying a sheet of dielectric material. The counterpoise coupler can come in a variety of shapes, so that the overall antenna may take on a number of form factors. For example, the counterpoise coupler may form a "T" shape comprising a stem with the single-feedpoint interface, and a crossbar bisecting the stem, having the first radiator interface and the second radiator interface. The "T" shaped counterpoise coupler crossbar may also be tapered to mate with different width lines.

Additional details of the above-described antenna are provided below.

BRIEF DESCRIPTION OF THE DRAWINGS

FIGS. 5A and 5B are partial cross-sectional views showing some variations of antenna orientation when a flexible dielectric is used.

FIGS. 6A through 6C are perspective views of different counterpoise coupler orientations.

FIG. 11 is a plan view depicting a fourth variation of the counterpoise coupler of FIG. 3.

FIG. 12 is a plan view depicting a fifth variation of the counterpoise coupler of FIG. 3.

FIG. 13 is a schematic block diagram of a wireless communications device with a single-feedpoint multiband monopole antenna having independent radiator elements.

DETAILED DESCRIPTION OF THE INVENTION

Figure 1:
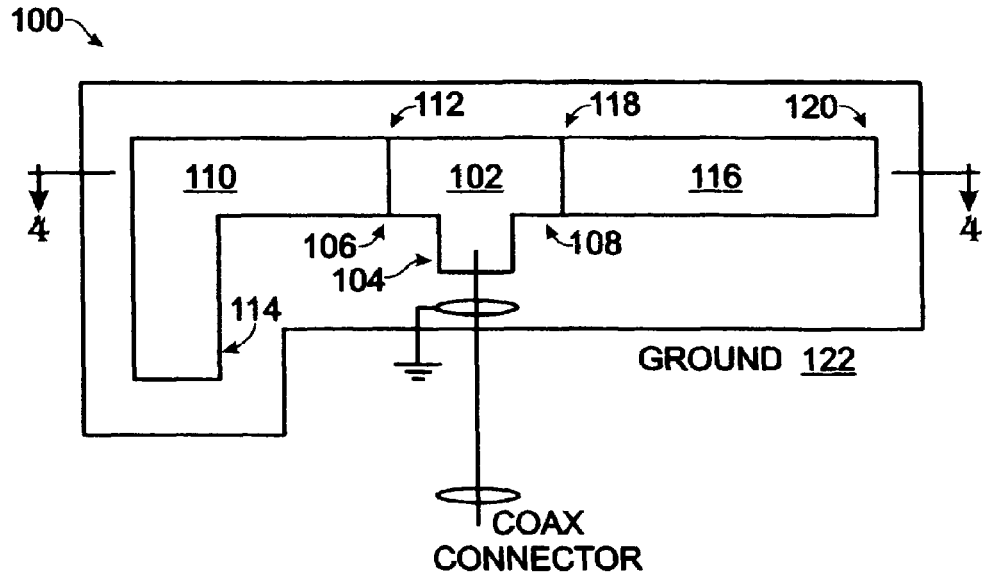
FIG. 1 is a plan view of a single-feedpoint multiband monopole antenna with independent radiator elements.

FIG. 1 is a plan view of a single-feedpoint multiband monopole antenna with independent radiator elements. The antenna 100 comprises a microstrip counterpoise coupler 102 having a single-feedpoint interface 104, a first radiator interface 106, and a second radiator interface 108. A first (right-angle) microstrip radiator 110 has an end 112 connected to the counterpoise coupler first radiator interface 106, and an unterminated end 114. The first microstrip radiator 110 is capable of resonating at a first center frequency. A second microstrip radiator 116 has an end 118 connected to the counterpoise coupler second radiator interface 108, and an unterminated end 120. The second microstrip radiator 116 is capable of resonating at a second center frequency, non-harmonically related to the first frequency. A groundplane 122 is also shown as co-planar. However, in other aspects not shown in this figure, the groundplane can underlie or overlie the radiators 110/116.

Figure 2A:
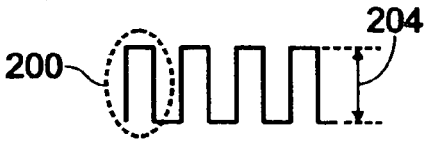
FIGS. 2A through 2E are plan views showing different aspects of the first radiator of FIG. 1.

FIGS. 2A through 2E are plan views showing different aspects of the first radiator of FIG. 1. Here, the first microstrip radiator 110 is a microstrip meander-line radiator comprising a plurality of sections having a shape 200, a pitch 202, a height, 204, and an offset 206. As shown in FIG. 2A, the shape 200 is rectangular, the pitch is equal (there is no pitch), the height 204 is equal (uniform), and there is no offset.

Figure 2B:
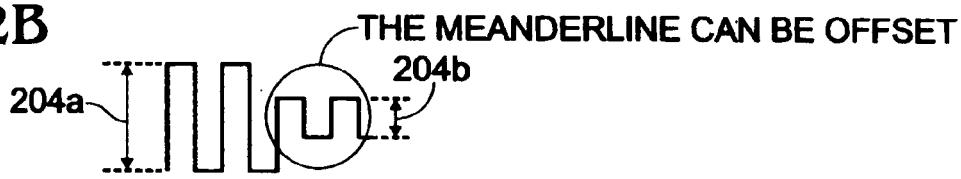

FIG. 2B shows a meander line radiator 110 with a rectangular shape, an equal pitch, an unequal heights 204*a* and 204*b*, with no offset.

Figure 2C:
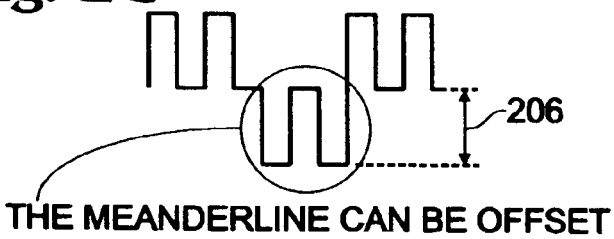

FIG. 2C shows a meander line radiator 110 with a rectangular shape, an equal pitch, an equal height, with an offset 206.

Figure 2D:
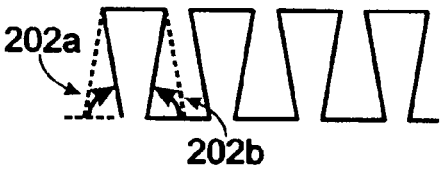

FIG. 2D shows a meander line radiator 110 with a zig-zag shape, a pitch 202*a* and 202*b*, an equal height, with no offset.

Figure 2E:
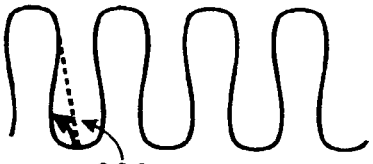

FIG. 2E shows a meander line radiator 110 with a round shape, a pitch 202, an equal height, with no offset.

Meander line radiators are an effective way of forming a relatively long effective electrical quarter-wavelength, for relatively low frequencies. The summation of all the sections contributes to the overall length of the meandering line. The meander line is not necessarily limited to any particular shape, pattern, or length.

Figure 3:
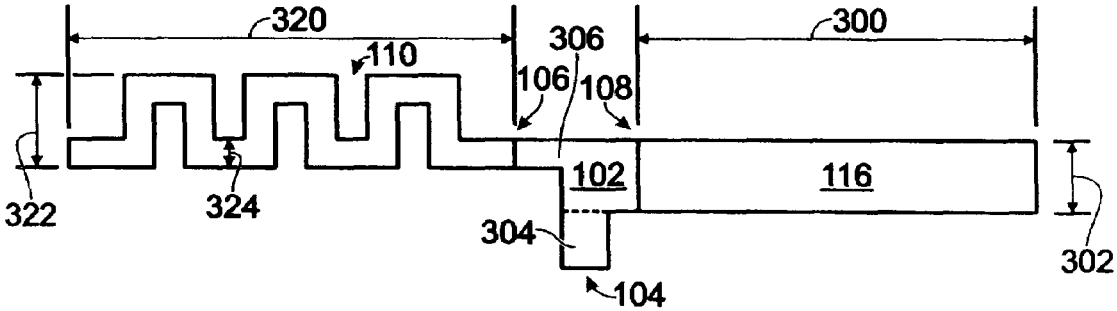
FIG. 3 is a plan view of a first variation of the antenna of FIG. 1, using a microstrip meander line radiator and straight-line radiator.

FIG. 3 is a plan view of a first variation of the antenna of FIG. 1, using a microstrip meander line radiator and straight-line radiator. The second microstrip radiator 116 is a microstrip straight-line radiator having a length 300 and a width 302, and a second bandpass associated with the second center frequency. Typically, the meander line radiator 110 has a first bandpass associated with the first center frequency, smaller than the second bandpass, as the frequency of the first bandpass is usually lower than the frequency of the second bandpass. This design permits the radiators to be significantly different in effective electrical length, while the antenna retains an overall symmetrical shape, as the form factor (space occupied) of the two radiators is approximately equal.

Figure 4:
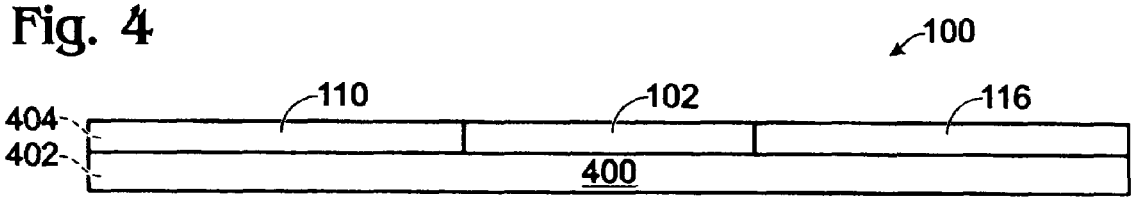
FIG. 4 is a partial cross-sectional view of the antenna of FIG. 1.

FIG. 4 is a partial cross-sectional view of the antenna of FIG. 1. The microstrip counterpoise coupler 102 is a conductive trace formed overlying a sheet of dielectric material 400. Likewise, the first microstrip radiator 110 is a conductive trace formed overlying a sheet of dielectric material 400, and the second microstrip radiator 116 is a conductive trace formed overlying a sheet of dielectric material 400. This figure shows the antenna formed over a single (same) sheet of dielectric 400 in a first plane 402, with the counterpoise coupler 102 and radiators 110/116 formed in a second plane 404. However, as described in more detail below, none of the above-mentioned elements need necessarily be formed in a single, continuous plane.

FIGS. 5A and 5B are partial cross-sectional views showing some variations of antenna orientation when a flexible dielectric is used. As seen in either figure, the counterpoise coupler 102, first microstrip radiator 110, and second microstrip radiator are formed overlying the same, flexible sheet of dielectric material 500 in a plurality of planes. In this aspect, the ground (not shown) may, or may not directly underlie the dielectric 500.

FIGS. 6A through 6C are perspective views of different counterpoise coupler orientations. In FIG. 6A, the counterpoise coupler has a single-plane orientation, similar to FIGS. 1 and 3. FIGS. 6B and 6C depict multi-planar orientations. In FIG. 6B, the stem of a "T" shaped counterpoise coupler 102 is formed in two orthogonal planes. In FIG. 6C, the crossbar section of a "T" shaped counterpoise coupler is formed in two orthogonal planes. Note, the counterpoise coupler can be formed in more than two planes. Further, the planes need not be orthogonal. Regardless of the planar orientation of the counterpoise coupler, the first microstrip radiator 110 and the second microstrip radiator 116 resonate at the first and second center frequencies, respectively, independent of the counterpoise coupler orientation.

Figures 7A, 7B, 7C, 7D:
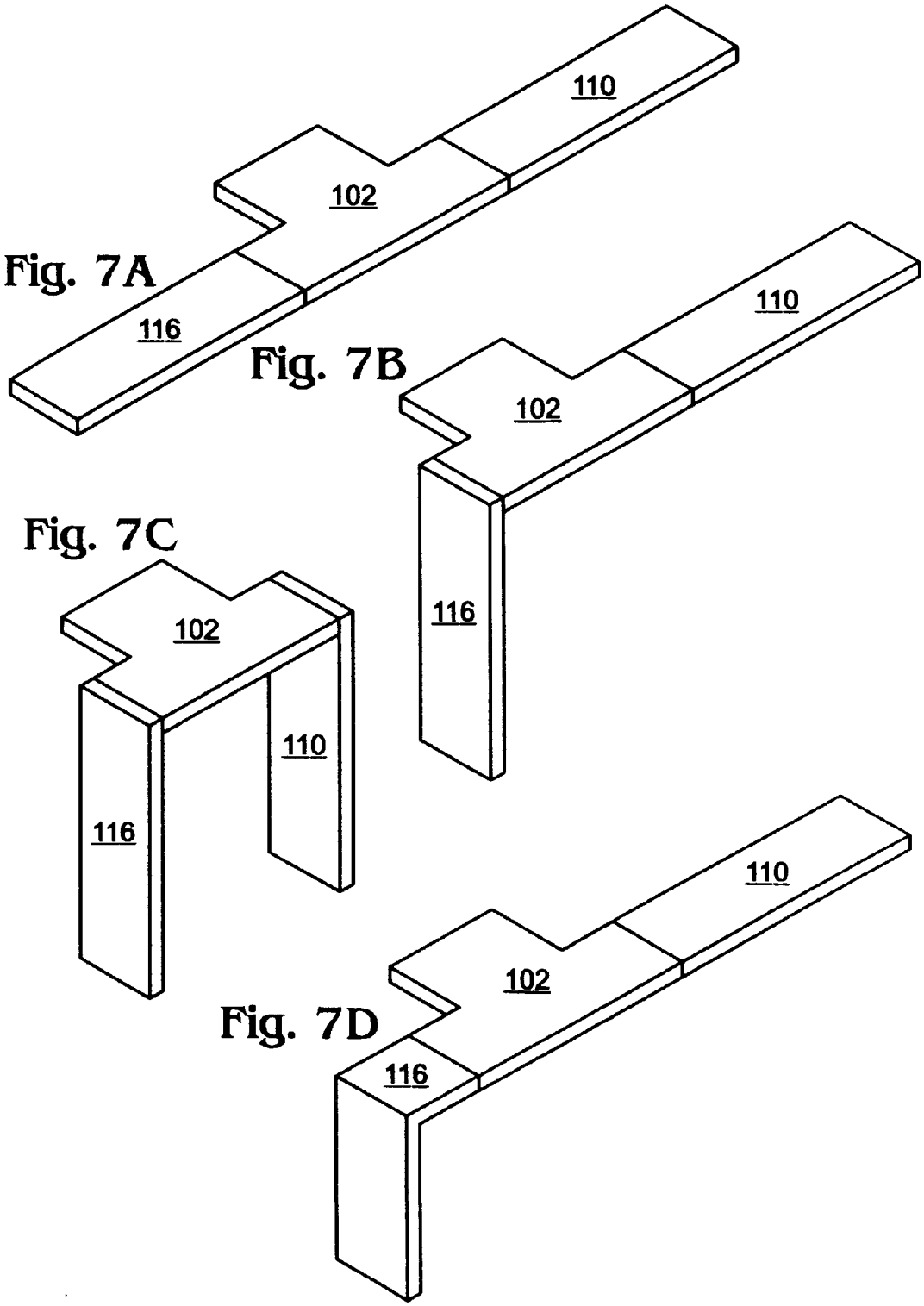
FIGS. 7A through 7D are perspective views of different radiator orientations.

FIGS. 7A through 7D are perspective views of different radiator orientations. In FIG. 7A, the first microstrip radiator 110 and the second microstrip radiator 116 have a single-plane orientation, as in FIGS. 1 and 3. In FIGS. 7B through 7D, the radiators 110/116 have a multi-planar orientation. In FIG. 7B, the radiators 110/116 are formed in two orthogonal planes. In FIG. 7C, the radiators are formed in parallel planes. In FIG. 7D, radiator 116 is formed in two orthogonal planes. Note, each radiator can be formed in one, two, or more than two planes. Further, the planes need not be orthogonal. Regardless of the planar orientation of the radiators, the first microstrip radiator 110 and the second microstrip radiator 116 resonate at the first and second center frequencies, respectively, independent of the relative radiator orientation.

The independence of the radiators, to radiator position or orientation also means that the length of one radiator can be lengthened or shortened, to change center frequency, without impacting the frequency tuning of the other radiator.

Returning the FIG. 3, the counterpoise coupler 102 can be seen as formed in a "T" shape comprising a stem 304 with the single-feedpoint interface 104. A crossbar 306 bisects the stem 304, having the first radiator interface 106 and the second radiator interface 108. Note, a "T" shaped counterpoise coupler may also be used to interface two straight-line radiators or two meander line radiators.

Figure 8:
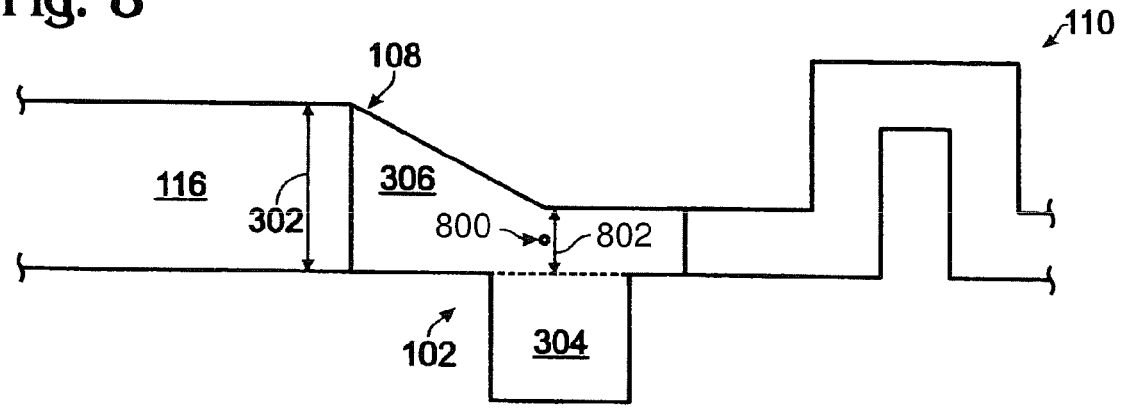
FIG. 8 is a plan view depicting a first variation of the counterpoise coupler of FIG. 3.

FIG. 8 is a plan view depicting a first variation of the counterpoise coupler of FIG. 3. As shown, the "T" shaped counterpoise coupler crossbar 306 includes a tapered width extending from the crossbar center 800 to the second radiator interface 108. The tapered width section of the crossbar has a width 802 at the center 800, and width 302 at the second radiator interface 108. Note, the counterpoise coupler 102 may also include a tapered section or width when formed in the other counterpoise coupler shapes described below.

Figure 9:
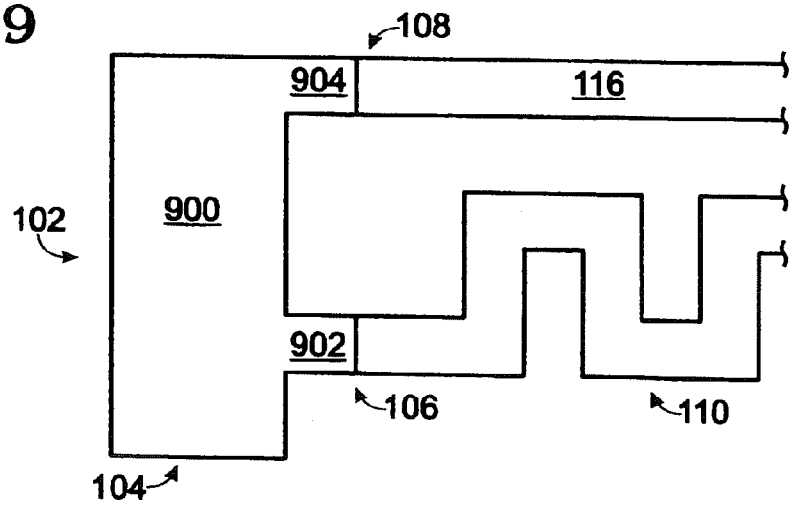
FIG. 9 is a plan view depicting a second variation of the counterpoise coupler of FIG. 3.

FIG. 9 is a plan view depicting a second variation of the counterpoise coupler of FIG. 3. The counterpoise coupler 102 forms an "F" shape and comprises a stem 900 with the single-feedpoint interface 104, and a lower partial crossbar 902 bisecting the stem 900, with a first radiator interface 106. An upper partial crossbar 904 intercepts the stem end opposite the interface 104, and has the second radiator interface 108. In other aspects not shown, the radiators 110/116 may couple directly to the stem 900, without the use of partial crossbars.

Figure 10:
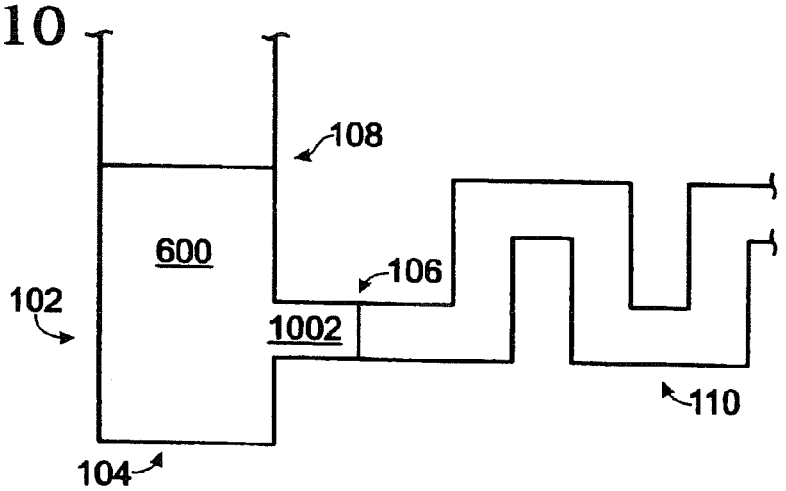
FIG. 10 is a plan view depicting a third variation of the counterpoise coupler of FIG. 3.

FIG. 10 is a plan view depicting a third variation of the counterpoise coupler of FIG. 3. The counterpoise coupler 102 forms a "partial-F" shape and comprises a stem 1000 having the single-feedpoint interface 104 and the second radiator interface 108. A lower partial crossbar 1002 bisects the stem 1000 and has the first radiator interface 106. In other aspects not shown, the radiators 110/116 may both couple directly to the stem 1000, without the use of partial crossbars.

FIG. 11 is a plan view depicting a fourth variation of the counterpoise coupler of FIG. 3. The counterpoise coupler 102 forms a "goalpost" shape and comprises a stem 1100 having the single-feedpoint interface 104. A first arm 1102 has the first radiator interface 106, and a second arm 1104 has the second radiator interface 108.

FIG. 12 is a plan view depicting a fifth variation of the counterpoise coupler of FIG. 3. The counterpoise coupler 102 forms a "Y" shape and comprises a stem 1200 having the single-feedpoint interface 104 at one end, and the first and second radiator interfaces 106/108 at a second end. A number of particular counterpoise coupler shapes have been presented above. As with the planar orientations, the first microstrip radiator 110 and the second microstrip radiator 116 resonate at the first and second center frequencies, respectively, independent of the counterpoise coupler shape. A few example shapes have been provided to illustrate the antenna, however, the antenna is not limited to any particular counterpoise coupler shape, or combination of shape and planar orientation.

Although the antenna is relatively independent of the positions of the radiators with respect to each other, the antenna is a monopole design, and so, dependent upon to position of the PCB groundplane. Alternately stated, the first microstrip radiator has a first bandpass associated with the first frequency, and the second microstrip radiator has a second bandpass associated with the second frequency. The first and second frequency bandpass responses are respectively dependent upon the position of the first and second microstrip radiators to the groundplane.

More particularly, it is the voltage standing wave ratio (VSWR) and bandwidth that are sensitive to the ground. If the radiators are positioned at a sub-optimal distance from ground, the VSWR and bandwidth are degraded. However, the radiator center frequency is insensitive to the radiators' position with respect to ground.

Generally, the counterpoise coupler performs two functions simultaneously. The counterpoise coupler is used to control the position of the radiators with respect to ground. That is, the counterpoise coupler's shape and planar orientation can be manipulated to best position the radiators. More particularly, the position of the first and second microstrip radiators to the groundplane is responsive to the counterpoise coupler width and length. Coupling between the counterpoise coupler and ground can be increased in response to widening the coupler, or making the coupler longer. That is, the coupling is increased by making the coupler surface area larger. The VSWR and bandpass responses of the two radiators are improved in response to increasing the coupling between the counterpoise coupler and ground.

Further, the counterpoise coupler acts as an impedance transformer. For example, the counterpoise coupler may transform from a 50-ohm impedance at the feedpoint interface 104, to different impedances at the first and second radiator interfaces 106/108. The width and length of the counterpoise coupler, in whatever coupler configuration, may be adjusted to modify impedance. Note, the first radiator impedance 106 and the second radiator impedance 108 are typically equal at their resonant frequencies, however, they need not be so.

For example, the counterpoise coupler may act as an impedance transformer across a broad frequency range (i.e., 500 MHz to 2 GHz), transforming a 50-ohm impedance at the single feedpoint to 25 ohms at the respective interfaces to the first and second radiators. If the first radiator is resonant at 800 MHz and the second radiator resonant at 1900 MHz, then the first radiator appears as a high impedance open stub to the second radiator at 1900 MHz. Likewise, at 800 MHz the second radiator appears as a high impedance open stub to the first radiator. For this reason, the radiators are insensitive to their positions with respect to each other. In addition, the counterpoise coupler can be used to simultaneously connect to two different loads, in close proximity, and act as an impedance transformer for both loads.

Alternately stated, the counterpoise coupler transforms impedance between the single-feedpoint interface and the first radiator interface at the first frequency. The impedance of the second radiator interface in parallel with the first radiator interface at the first frequency is substantially the first radiator interface impedance, as the second radiator interface impedance is relatively large. Likewise, the counterpoise coupler transforms impedance between the single-feedpoint interface and the second radiator interface at the second frequency. The impedance of the first radiator interface at the second frequency is relatively large, making the parallel combination the first and second radiator interfaces substantially equal to the second radiator interface impedance.

Returning briefly to FIG. 3, the meander line radiator 110 has an overall length 320 in the range of 34 to 38 millimeters (mm), an overall width 322 in the range of 7 to 10 mm, and a line width 324 in the range of 0.7 to 1 mm. The meander line radiator 110 resonates at a center frequency in the range of 1.5 to 2.0 gigahertz (GHz). The straight-line radiator 116 has a line length 300 in the range of 23 to 27 mm, a line width 302 in the range of 4.25 to 5.5 mm. The straight-line radiator 116 resonates at a center frequency in the range of 0.8 to 1.0 GHz.

The relationship between line length and frequency is dependent upon the dielectric constant of the dielectric sheet. The effective electrical length of a line is derived from the physical length of the line, as modified by the dielectric constant of the surrounding materials. The electrical length of a line increases as the dielectric constant increases. The above-mentioned length measurements assume a material with a dielectric constant in the range of 2 to 10. However, the antenna is not limited to any particular dielectric constant.

FIG. 13 is a schematic block diagram of a wireless communications device with a single-feedpoint multiband monopole antenna having independent radiator elements. The device 1300 comprises a transceiver 1302 having an interface 1304. The transceiver 1302 may be a receiver, transmitter, or both. The device 1300 has a chassis or case groundplane 1306. In some aspects, the groundplane is formed by printer circuit boards, displays, keyboards, or a combination of all the above-mentioned elements. The device 1300 also comprises a single-feedpoint antenna 100 with independent radiator elements.

As explained in greater detail above, the antenna comprises a microstrip counterpoise coupler 102 having a single-feedpoint interface 104 connected to the transceiver interface 1304, a first radiator interface 106, and a second radiator interface 108, see FIG. 1 or 3. A first microstrip radiator 110 has an end connected to the counterpoise coupler first radiator interface 106, and an unterminated end. The first microstrip radiator 110 is capable of resonating at a first frequency. A second microstrip radiator 116 has an end connected to the counterpoise coupler second radiator interface 108, and an unterminated end. The second microstrip radiator 116 is capable of resonating at a second frequency, non-harmonically related to the first frequency.

FUNCTIONAL DESCRIPTION

Figure 14:
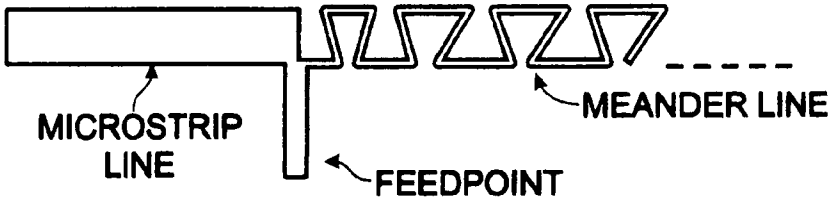
FIG. 14 is a plan view depicting another aspect of the antenna of FIG. 3.

FIG. 14 is a plan view depicting another aspect of the antenna of FIG. 3. As shown, the meander line is formed with a zig-zag shape. The meander and microstrip line antenna can resonate multiband with the signals input at the common feedpoint. This antenna can be a metal etched on non-conductive material, or it can be built on the flexible material, such as an insulating film or paper. For example, the material can be a polyester or polyimide film, such as Mylar® or Kapton®. Other material choices include a synthetic aromatic polyamide polymer, such as Nomex®. Further, phenolic sheets or polytetrafluoroethylene (PTFE), such as Teflon®, may be used. Chlorosulfonated polyethylene (i.e., Hypalon®), silicon sheets, ethylene propylene diene monomer (EPDM) are also good material choices. However, the dielectric is not limited to any particular material. A number of other conventional materials could be used to enable the invention. The conductive trace may be a material such as copper, silver, conductive ink, or tin. However, the connector is not limited to any particular materials.

The antenna can be used for handset, laptop computer, PC Card, and any other equipment that communicates using radiated electromagnetic energy. The VSWR of the low-band (meander arm) is around 2:1 with a wide bandwidth. The high-band (straight microstrip arm) radiator has a wider VSWR and bandwidth than the meander line radiator. The straight-line microstrip radiator can operate from GPS (1.575 GHz) to PCS band (Up to 2 GHz) frequencies, and can be adjusted for other bands such as Bluetooth by making the length longer or shorter. The GPS VSWR is about 2.5:1, and the PCS VSWR is about 2:1.

Figure 15:
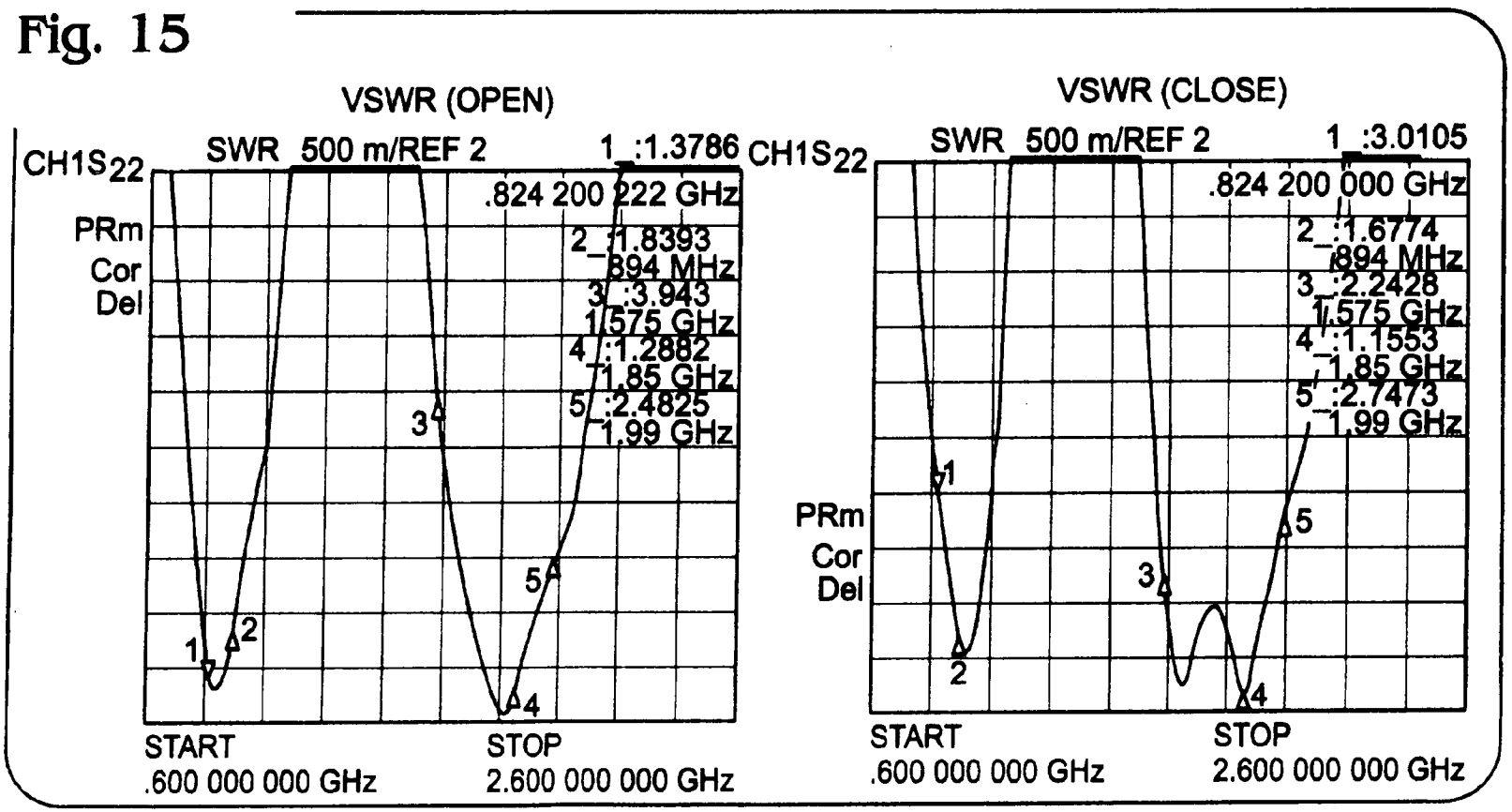
FIG. 15 is a pair of graphs depicting the VSWR response of the two antenna radiators as installed in a portable wireless telephone, in open and closed configurations.

FIG. 15 is a pair of graphs depicting the VSWR response of the two antenna radiators as installed in a portable wireless telephone, such as a "flip" phone, with flip-open and flip-closed configurations. The VSWR changes slightly in response to the different groundplanes associated with the telephone flip-open and flip-closed conditions.

In one aspect, the meander line radiator has an overall length of 36 mm, an overall width of 10 mm, and a line width of 1 mm. The straight-line radiator has an overall length of about 25 mm and a line width of about 5.5 mm. In another aspect, the meander line radiator has an overall length of 36 mm, an overall width of about 7 mm, and a line width of about 0.7 mm. The straight-line radiator has an overall length of about 25 mm and a line width of about 4.25 mm.

A single-feedpoint multiband monopole antenna has been provided with independent radiator elements. Examples of different radiator and counterpoise coupler shapes have been given to illustrate the invention. Likewise, different planar orientations and frequencies have been provided for the same reason. However, the antenna is not limited to merely these examples. Other variations and embodiments of the invention will occur to those skilled in the art.

What is claimed is:

1. A single-feedpoint multiband monopole antenna with independent radiator elements, the antenna comprising:

a "T" shaped microstrip counterpoise coupler comprising:

a stem comprising a single-feedpoint interface;

a cross bar bisecting the stem and comprising a first radiator interface, and a second radiator interface, at least one of the first radiator interface and the second radiator interface having a tapered width portion;

a first microstrip radiator with an end connected to the counterpoise coupler first radiator interface, and an unterminated end, the first microstrip radiator capable of resonating at a first center frequency;

a second microstrip radiator with an end connected to the counterpoise coupler second radiator interface, and an unterminated end, the second microstrip radiator capable of resonating at a second center frequency, non-harmonically related to the first frequency; and a groundplane.

2. The antenna of claim 1 wherein the first microstrip radiator is a microstrip meander-line radiator comprising a plurality of sections having a shape, a pitch, a height, and an offset.

3. The antenna of claim 2 wherein the second microstrip radiator is a microstrip straight-line radiator having a length and a width, and a second bandpass associated with the second center frequency; and wherein the meander line radiator has a first bandpass associated with the first center frequency, smaller than the second bandpass.

4. The antenna of claim 1 wherein the microstrip counterpoise coupler is a conductive trace formed overlying a sheet of dielectric material;

wherein the first microstrip radiator is a conductive trace formed overlying a sheet of dielectric material; and wherein the second microstrip radiator is a conductive trace formed overlying a sheet of dielectric material.

5. The antenna of claim 1 wherein the "T" shaped counterpoise coupler crossbar includes a tapered width extending from the crossbar center to the second radiator interface.

6. The antenna of claim 4 wherein the counterpoise coupler, first microstrip radiator, and second microstrip radiator are formed overlying the same sheet of dielectric material.

7. The antenna of claim 4 wherein the counterpoise coupler, first microstrip radiator, and second microstrip radiator are formed overlying the same, flexible sheet of dielectric material in a plurality of planes.

8. The antenna of claim 4 wherein the counterpoise coupler has a orientation selected from the group comprising single-plane and multi-planar; and, wherein the first and second microstrip radiators resonate at the first and second center frequencies, respectively, independent of the counterpoise coupler orientation.

9. The antenna of claim 4 wherein the first and second microstrip radiators have a relative orientation selected from the group comprising single-plane and multi-planar; and, wherein the first and second microstrip radiators resonate at the first and second center frequencies, respectively, independent of the relative radiator orientation.

10. The antenna of claim 1 wherein the first microstrip radiator has a first bandpass associated with the first frequency;

wherein the second microstrip radiator has a second bandpass associated with the second frequency; and wherein the first and second frequency bandpass responses are respectively dependent upon the position of the first and second microstrip radiators to the groundplane.

11. The antenna of claim 10 wherein the voltage standing wave ratio (VSWR) and bandwidth responses of the first and second microstrip radiators are responsive to the counterpoise coupler width and length.

12. The antenna of claim 1 wherein the counterpoise coupler transforms impedance between the single-feedpoint interface and the first radiator interface at the first frequency; and wherein the counterpoise coupler transforms impedance between the single-feedpoint interface and the second radiator interface at the second frequency.

13. The antenna of claim 3 wherein the meander line radiator has an overall length in the range of 34 to 38 millimeters (mm), an overall width in the range of 7 to 10 mm, and a line width in the range of 0.7 to 1 mm, and resonates at a center frequency in the range of 1.5 to 2.0 gigahertz (GHz); and wherein the straight-line radiator has a line length in the range of 23 to 27 mm, a line width in the range of 4.25 to 5.5 mm, and resonates at a center frequency in the range of 0.8 to 1.0 GHz.

14. A single-feedpoint multiband monopole antenna with independent radiator elements, the antenna comprising:

a microstrip counterpoise coupler comprising:

a stem comprising having a single-feedpoint interface and positioned in a stem plane;

a first arm having a first radiator interface and positioned in a first arm plane non-parallel to the stem plane; and second arm having a second radiator interface and positioned within a second arm plane non-parallel to the stem plane;

a first microstrip radiator with an end connected to the counterpoise coupler first radiator interface, and an unterminated end, the first microstrip radiator capable of resonating at a first center frequency; and a second microstrip radiator with an end connected to the counterpoise coupler second radiator interface, and an unterminated end, the second microstrip radiator capable of resonating at a second center frequency, non-harmonically related to the first frequency.

15. The antenna of claim 14 wherein the first microstrip radiator is a microstrip meander-line radiator comprising a plurality of sections having a shape, a pitch, a height, and an offset.

16. The single-feedpoint multiband monopole antenna of claim 14, wherein the first arm plane is parallel to the second arm plane.

* * * * *